US008453350B2

(12) United States Patent
Yang

(10) Patent No.: US 8,453,350 B2
(45) Date of Patent: Jun. 4, 2013

(54) COMBINATION STRUCTURE FOR SHOE SHELL

(75) Inventor: Hsin-Chih Yang, Kaohsiung (TW)

(73) Assignee: Sakurai Sports Mfg. Co., Ltd., Kaohsiung (TW)

( * ) Notice: Subject to any disclaimer, the term of this patent is extended or adjusted under 35 U.S.C. 154(b) by 440 days.

(21) Appl. No.: 12/836,048

(22) Filed: Jul. 14, 2010

(65) Prior Publication Data

US 2012/0011742 A1 Jan. 19, 2012

(51) Int. Cl.
*A43C 13/14* (2006.01)

(52) U.S. Cl.
USPC ..... 36/77 R; 36/100

(58) Field of Classification Search
USPC ..... 36/77 R, 77 M, 100, 101
See application file for complete search history.

(56) References Cited

U.S. PATENT DOCUMENTS

| | | | | |
|---|---|---|---|---|
| 1,608,879 | A * | 11/1926 | Hawkins | 36/8.4 |
| 2,292,297 | A * | 8/1942 | Sherlock | 36/1 |
| 4,177,583 | A * | 12/1979 | Chapman | 36/77 R |
| 4,811,501 | A * | 3/1989 | Okayasu | 36/94 |
| 4,995,174 | A * | 2/1991 | Hong et al. | 36/72 R |
| 6,272,771 | B1 * | 8/2001 | Rodi | 36/77 R |
| 7,421,807 | B2 * | 9/2008 | Condie | 36/101 |
| 2003/0041479 | A1 * | 3/2003 | Covatch | 36/77 R |
| 2003/0213149 | A1 * | 11/2003 | Woods | 36/110 |
| 2003/0226285 | A1 * | 12/2003 | Covatch | 36/77 R |
| 2007/0068045 | A1 * | 3/2007 | Condie | 36/101 |
| 2008/0052959 | A1 * | 3/2008 | Hu | 36/42 |
| 2010/0126042 | A1 * | 5/2010 | Wyon | 36/98 |

* cited by examiner

*Primary Examiner* — Marie Patterson
(74) *Attorney, Agent, or Firm* — Bacon & Thomas, PLLC

(57) ABSTRACT

A combination structure for a shoe shell has a shoe body, a toecap mounted on a front end of the shoe body and at least one connecting part disposed between the shoe body and the toecap. Each of the at least one connecting part has a female connector and a male connector formed respectively on the shoe body and the toecap and is mounted with each other. Connecting the toecap to the shoe body through the at least one connecting part is an improved quick and time saving process. Furthermore, the toecap is attached securely to the shoe body and not easily detached from the shoe body.

9 Claims, 3 Drawing Sheets

COMBINATION STRUCTURE FOR SHOE SHELL

BACKGROUND OF THE INVENTION

1. Field of the Invention

The present invention relates to a combination structure for a shoe shell, especially to a combination structure for a shoe shell that comprises a shoe body and a toecap.

2. Description of the Prior Art(s)

People wear shoes to protect their feet from injury. Different kinds of shoes are adapted for different uses. For instance, athletic shoes are adapted for walking, running, hiking, climbing and other athletic activities. As for some sports, such as ice skating, inline skating or the like, a rigid shoe shell is needed for sufficient protection.

A conventional shoe shell comprises a shoe body and a toecap attached to the shoe body. Since the shoe body and the toecap are made of plastic or carbon fiber and are hard enough to protect the feet, attaching the toecap to the shoe body with stitches is difficult. In addition, when the shoe body and the toecap are riveted together, the rivets protrude in the shoe body and make wearing the shoes uncomfortable. Thus, in general, the shoe body and the toecap are adhered to each other with an adhesive. However, it takes time for the adhesive to dry in order for the shoe body and the toecap to be held together. Moreover, when an exterior force is applied, the toecap is easily displaced or even detached from the shoe body.

To overcome the shortcomings, the present invention provides a combination structure for a shoe shell to mitigate or obviate the aforementioned problems.

SUMMARY OF THE INVENTION

The main objective of the present invention is to provide a combination structure for a shoe shell. The combination structure for a shoe shell has a shoe body, a toecap mounted on a front end of the shoe body and at least one connecting part disposed between the shoe body and the toecap. Each of the at least one connecting part has a female connector and a male connector formed respectively on the shoe body and the toecap and is mounted with each other.

Connecting the toecap to the shoe body through the at least one connecting part is an improved quick and time saving process. Furthermore, the toecap is attached securely to the shoe body and not easily detached from the shoe body.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
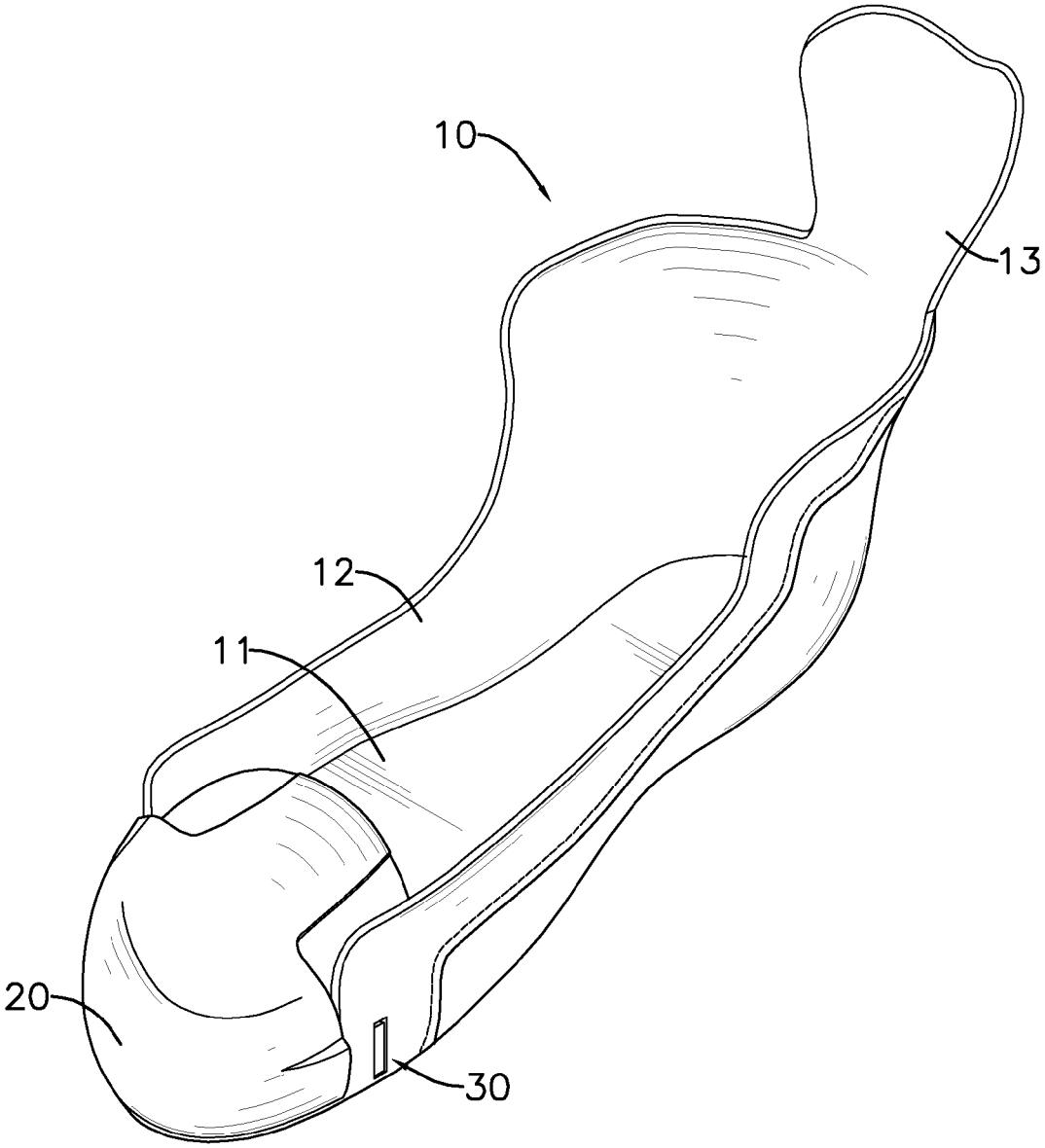
FIG. 1 is a perspective view of a combination structure for a shoe shell in accordance with the present invention.
Figure 2:
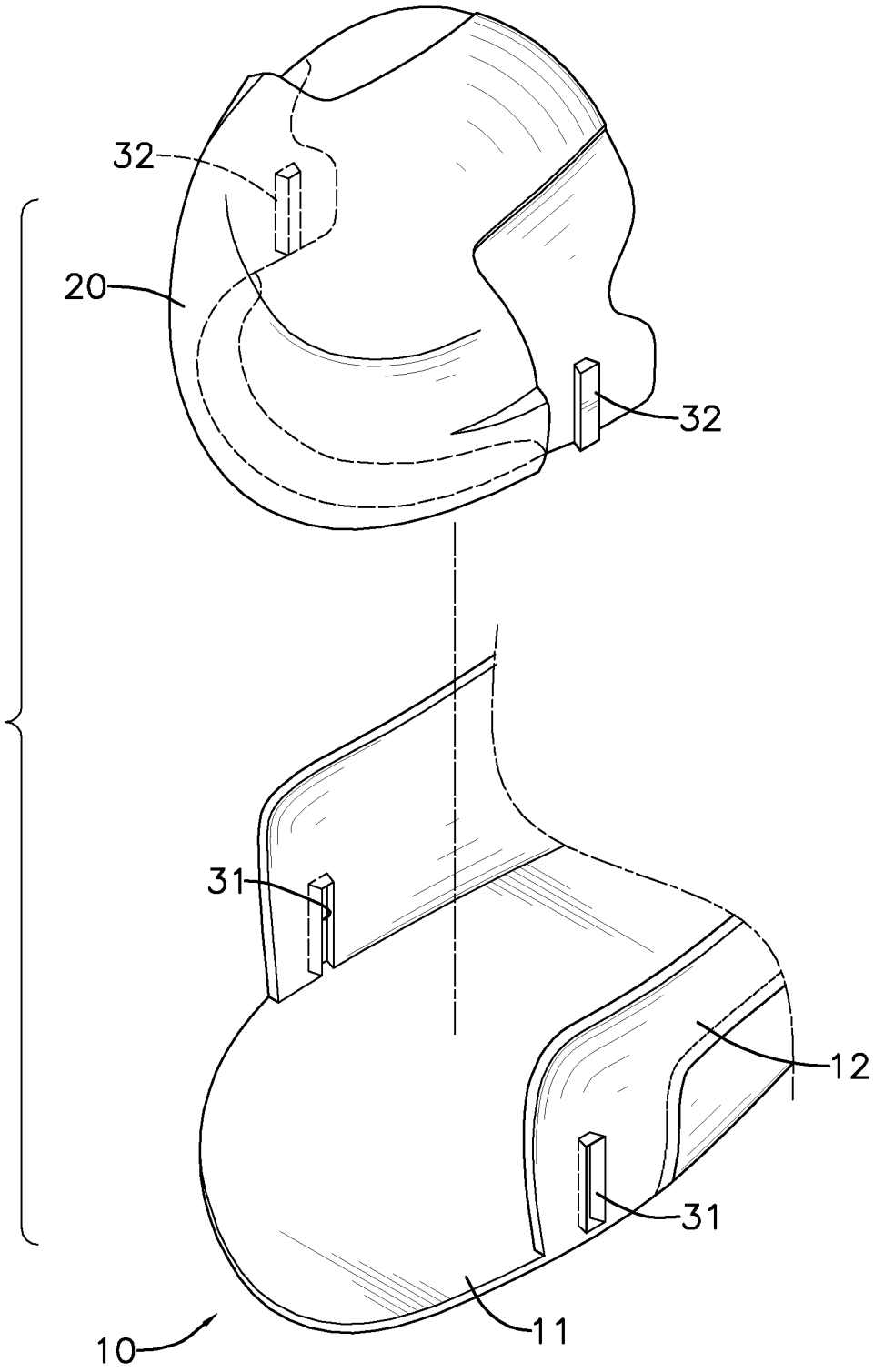
FIG. 2 is an enlarged exploded perspective view of the combination structure for the shoe shell in FIG. 1.

With reference to FIGS. 1 and 2, a combination structure for a shoe shell in accordance with the present invention comprises a shoe body 10, a toecap 20 and at least one connecting part 30.

The shoe body 10 is formed integrally as s single part and has a sole 11, two lateral vamps 12 and a rear protection sheet 13. The sole 11 corresponds to the sole of a user's foot. The lateral vamps 12 respectively extend up from two opposite side edges of the sole 11. Each lateral vamp 12 has an inner surface. The rear protection sheet 13 extends up from a rear edge of the sole 11 and is attached to the lateral vamps 12.

The toecap 20 is mounted on a front end of the sole 11 and has two opposite outer side surfaces respectively corresponding to the inner surfaces of the lateral vamps 12.

Figure 3:
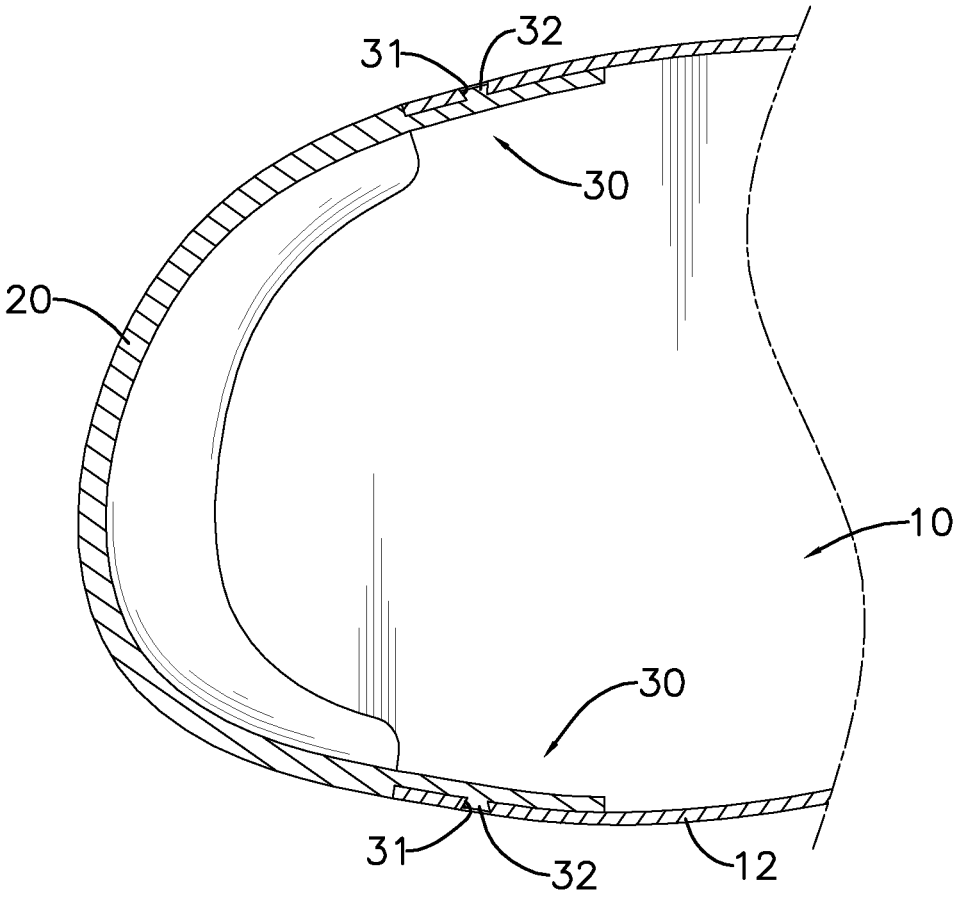
FIG. 3 is a cross-sectional top view of the combination structure for the shoe shell in FIG. 1.

With further reference to FIG. 3, the at least one connecting part 30 is disposed between the lateral vamps 12 and the toecap 20. Each of the at least one connecting part 30 has a female connector 31 and a male connector 32. The female and male connectors 31, 32 are formed respectively on corresponding inner surfaces of the lateral vamp 12 and the outer side surface of the toecap 20 and are mounted with each other.

In a preferred embodiment, the female connector 31 is an engaging recess formed in the inner surface of the lateral vamp 12, and may be further formed through the lateral vamp 12 and being dovetail-shaped in cross-section. The male connector 32 is an engaging protrusion, is dovetail-shaped in cross-section and engages the engaging recess of the female connector 31.

Preferably, the female connector 31 is formed on the inner surface of the lateral vamp 12. The male connector 32 is formed on the outer side surface of the toecap 20.

The combination structure for the shoe shell as described has the following advantages. Since no adhesive is needed to adhere the toecap 20 to the shoe body 10, connecting the toecap 20 to the shoe body 10 through the at least one connecting part 30 is an improved quick and time saving process. Furthermore, the toecap 20 is attached securely to the shoe body 10 and is not easily detached from the shoe body 10.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A combination structure for a shoe shell comprising:

a shoe body having a sole; and two lateral vamps respectively extending up from two opposite side edges of the sole, and each lateral vamp having an inner surface;

a toecap mounted on a front end of the sole and having two opposite outer side surfaces respectively corresponding to the inner surfaces of the lateral vamps; and at least one connecting part disposed between at least one of the lateral vamps and the toecap, and each of the at least one connecting part having a female connector and a male connector formed respectively on a corresponding inner surface of the lateral vamp and a corresponding outer side surface of the toecap and mounted with each other;

wherein the female connector of each of the at least one connecting part is an engaging recess formed in the inner surface of the lateral vamp; and the male connector of each of the at least one connecting part is an engaging protrusion and engages the engaging recess of the female connector.

2. The combination structure for the shoe shell as claimed in claim 1, wherein the engaging recess of the female connector of each of the at least one connecting part and the engaging protrusion of the male connector of each of the at least one connecting part are dovetail-shaped in cross-section.

3. The combination structure for the shoe shell as claimed in claim 1, wherein the female connector of each of the at least one connecting part is formed on the inner surface of the lateral vamp; and the male connector of each of the at least one connecting part is formed on the outer side surface of the toecap.

4. The combination structure for the shoe shell as claimed in claim 2, wherein the female connector of each of the at least one connecting part is formed on the inner surface of the lateral vamp; and the male connector of each of the at least one connecting part is formed on the outer side surface of the toecap.

5. The combination structure for the shoe shell as claimed in claim 1, wherein the shoe body further has a rear protection sheet extending up from a rear edge of the sole and attached to the lateral vamps.

6. The combination structure for the shoe shell as claimed in claim 2, wherein the shoe body further has a rear protection sheet extending up from a rear edge of the sole and attached to the lateral vamps.

7. The combination structure for the shoe shell as claimed in claim 5, wherein the shoe body is formed integrally as a single part.

8. The combination structure for the shoe shell as claimed in claim 6, wherein the shoe body is formed integrally as a single part.

9. The combination structure for the shoe shell as claimed in claim 1, wherein the engaging recess of the female connector of each of the at least one connecting part is further formed through the inner surface of the lateral vamp.

* * * * *